United States Patent [19]

Thorsell et al.

[11] 4,037,537

[45] July 26, 1977

[54] METHOD AND A DEVICE FOR BLASTING

[75] Inventors: Torgny Thorsell; Torbjörn Svensson, both of Skelleftea, Sweden

[73] Assignee: Linden-Alimak AB, Skelleftea, Sweden

[21] Appl. No.: 618,279

[22] Filed: Sept. 30, 1975

[51] Int. Cl.[2] ..... F42D 3/10

[52] U.S. Cl. ..... 102/22 R; 102/705; 102/81

[58] Field of Search ..... 102/81, 7, 705, 22

[56] References Cited

U.S. PATENT DOCUMENTS

| | | | |
|---|---|---|---|
| 1,514,743 | 11/1924 | Taylor | 102/7 |
| 2,462,305 | 2/1949 | Catlin | 102/81 X |
| 3,015,270 | 1/1962 | Domingos et al. | 102/81 X |
| 3,128,704 | 4/1964 | Noddin et al. | 102/81 X |
| 3,532,057 | 10/1970 | Aubrey | 102/7 X |
| 3,583,320 | 6/1971 | Gawlick et al. | 102/81 |
| 3,842,740 | 10/1974 | Mirlesse | 102/705 X |

*Primary Examiner*—David H. Brown

[57] ABSTRACT

A blasting cap is detonated to convey a shock wave to thereby initiate the explosion of an explosive charge by means of a remotely operable pressurized fluid operated blasting cap detonating device including a fluid pressure operating piston, a compression spring operable to absorb energy from the piston, and a striking pin operable for release by engagement thereof by the piston and then operable for final movement in response to force from the compression spring.

6 Claims, 2 Drawing Figures

METHOD AND A DEVICE FOR BLASTING

Figure 1:
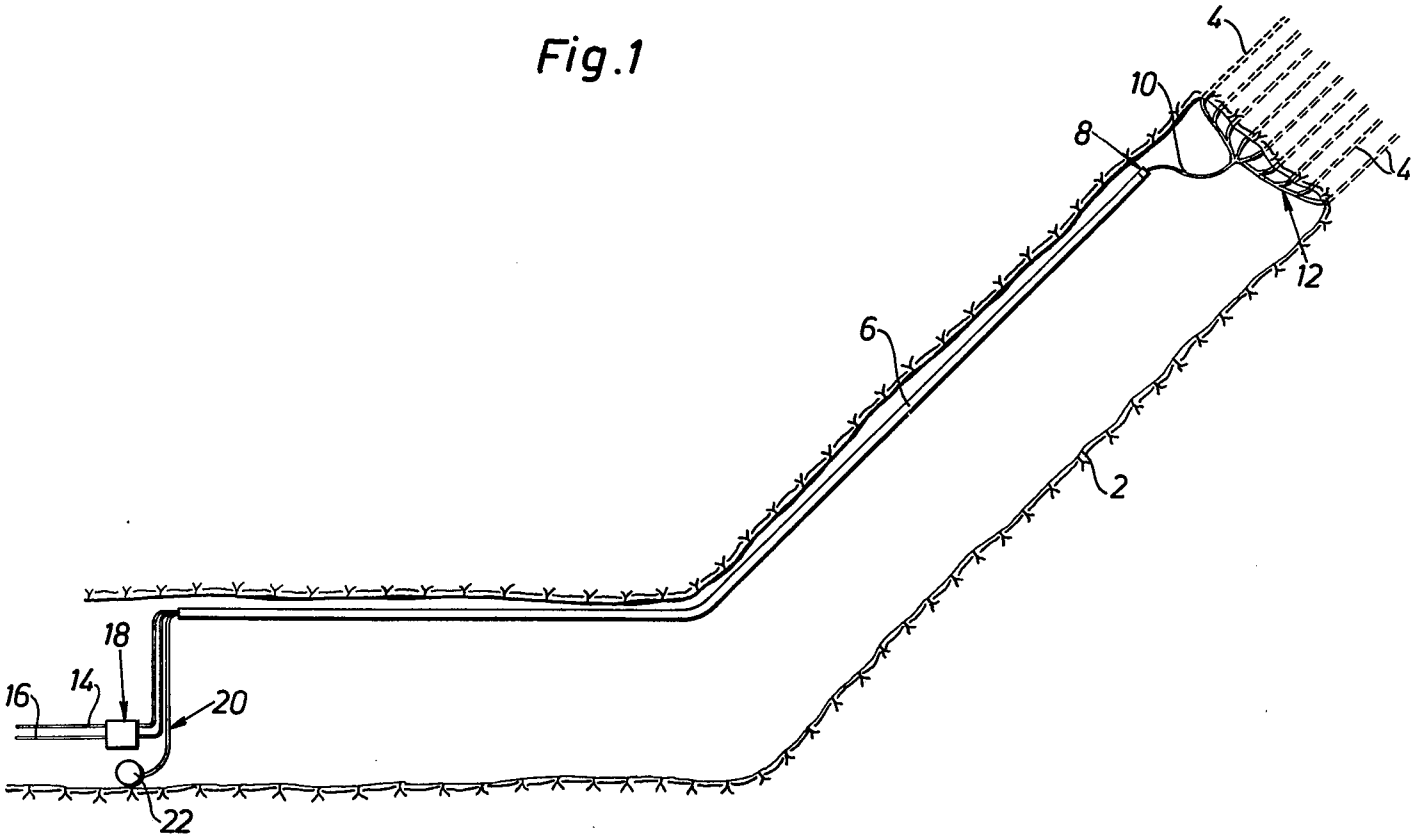

The present invention relates to a method and a device for blasting, comprising the step of initiating an explosive charge by means of a shock-wave transmitted to the charge by means of a shock-wave conductor, said shock-wave being produced at the end of the shock-wave conductor remote from the blasting charge by detonating a blasting cap.

In connection with blasting operations, initiation of the explosive is mostly carried through electrically by means of electric blasting caps. This method is used in connection with blasting both above and below ground, and has turned out to be safe and reliable.

It has, however, some disadvantages. Thus, there are e.g. certain risks that after the electric circuit has been established the blasting charge may be initiated by electric fields in the neighbourhood, e.g. from electric generating plants, or by lightning and thunder storms.

Electric plants in the direct neighbourhood of the working site are therefore made neutral before the loading work starts. At most working sites there should furthermore be storm warning devices, i.e. instruments sensing the electric activity of the atmosphere. The lightning risk is estimated before the loading work starts, and if lightning storms arise the work must be interrupted and the staff leave the working site. In some places of the world lightning is a great problem and a substantial element of risk.

In order to eliminate the disadvantages of electrical initiation there has been developed a non-electrical system, where initiation is carried through by means of a shock-wave via a thin plastic tube functioning as a shock-wave conductor.

The shock-wave in the plastic tube may be initiated in several ways, e.g. by means of a particular initiating pistol, or by a conventional fuse blasting cap.

The tube must extend from the charge to a place outside the risk zone. This is a practical and economic disadvantage especially appearing in connection with driving of a long inclined shaft, where the whole length of the shaft is within the risk zone. When driving e.g. pressure shafts for water power plants, the shaft length may nowadays be up to 800 - 1200 m.

The object of the invention is to provide an initiation method and device completely eliminating the disadvantages of prior art electrical initiation and shock-wave initiation.

This object has been attained by detonating the blasting cap by means of a pressurized fluid operated initiator.

A very great proportion of the shafts driven nowadays are driven by means of raise lifts or drill units carried by and movable on a guide rail comprising interconnected standardized rail sections. Concurrently as the driving work proceeds the guide rail is lengthened by means of new rail sections so that the guide rail extends to near the end of the shaft. Such shaft driving methods and devices are described in the Swedish Pat. Nos. 214,056 and 346,828 and in the corresponding U.S. Pat. Nos. 3,016,989 and 3,830,338, respectively.

The invention is i.a. usable in connection with shaft driving methods of the kind above described, and for that purpose a pressurized air operated percussion initiator is used which is located at the upper end of the guide rail and remotely controlled from the bottom of the shaft by means of pressurized air. The explosive charges in the drill holes are connected to the initator by means of a shock-wave conductor which may be of a kind known per se. The initiator is connected to an operating air line extending along the guide rail and being connectable to a pressurized air line at the bottom of the shaft, outside the risk zone.

Air and water for the drills is normally supplied via the guide rail. To protect the free end of the guide rail against blasting damages it may be provided with a top cover. By connecting the initiator to the underside of the top cover the initiator will be located inside the topmost rail section where it is well protected.

Figure 2:
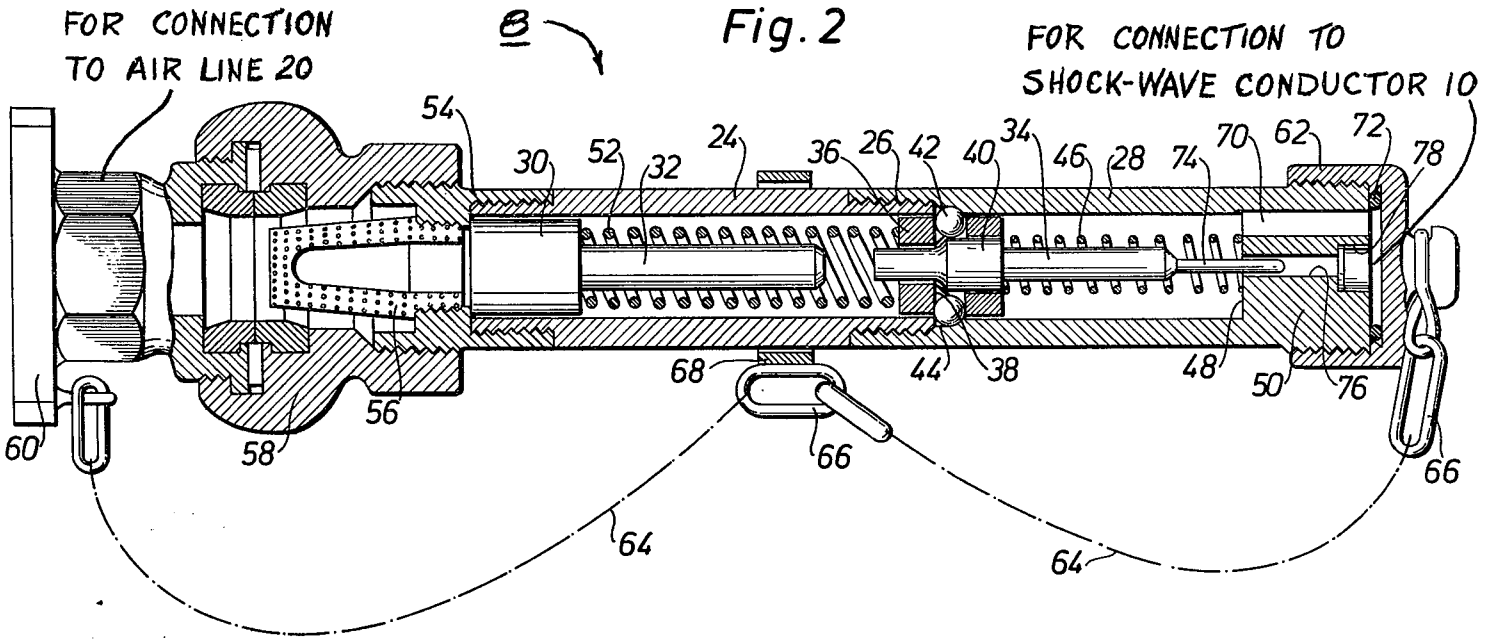

The invention and the different aspects thereof will now be described more closely below with reference to the accompanying drawings, on which FIG. 1 is a longitudinal section through a raise illustrating one embodiment of the method according to the invention, and FIG. 2 is a view, mainly in longitudinal section, of an initiator device according to the invention.

In FIG. 1 a raise is generally denoted by 2, at the top of which schematically illustrated drill holes 4 have been filled with explosives. Driving of the raise is generally assumed to take place by means of the known method described above, in which a drill unit is carried by and movable on a guide rail mounted on the shaft wall and comprising interconnected standardized guide rail sections. The guide rail has been referenced 6 in FIG. 1. At the top of the guide rail 6 a pressurized air operated percussion initiator 8 is protectively arranged inside the guide rail under a top cover, not shown. A preferred embodiment of such a percussion initiator is described more closely below with reference to FIG. 2. The percussion initiator 8 is intended to detonate a blasting cap arranged thereat and the shock-wave arising from the detonation is conducted through a shock-wave conductor 10 connected to the initiator and through branch conductors 12 to the different drill holes 4.

Schematically illustrated air and water lines 14 and 16 for the drills, not shown, extend through the guide rail 6. The lines 14 and 16 pass into a switch central 18 in which corresponding lines located on the guide rail side of the switch central may be connected or disconnected. Furthermore a pressurized air line 20 extends through the guide rail up to the pressurized air operated percussion initiator 8. The line 20 is connected to a supply line, not shown, via an air valve schematically shown at 22.

When the blasting cap at the percussion detonator 8 is to be detonated, the air valve 22 is opened to supply pressurized air to the percussion initiator 8. The activation may in practice take place at e.g. 5 kg/cm$^2$. During drilling and loading of drill holes the line 20 is disconnected and evacuated.

By means of the initiation method described above for producing a shock-wave in the tubes 10 and 12, the disadvantages of electrical initiation and conventional shock-wave initiation, described above, are completely eliminated. The method according to the invention is thus independent of electrical fields in the neighbourhood, and thunderstorms, and furthermore relatively very short shock-wave tube lengths are required.

A preferred embodiment of a pressurized air operated percussion initiator device that can be used at 8 in FIG. 1 is shown in FIG. 2.

The percussion initiator device comprises a cylinder body 24 connected, by means of threads shown schematically at 26, to a sleeve 28 coaxially arranged with respect to the cylinder and having essentially the same transverse dimensions. An operating element which is a piston having a piston head 30 and a coaxial smaller diameter operating pin 32 is movable in the cylinder 24. A striking pin 34 extends by part of its length through a cylinder shaped ball holder 36 movable with clearance in the sleeve 28. The ball holder 36 in its inner wall has an annular shoulder 38 cooperating with a corresponding shoulder 40 on the striking pin 34 to present movement of the striking pin to the left in FIG. 2 with respect to the holder 36. The striking pin 34 is, however, movable to the right with respect to the holder 36.

The ball holder 36 contains balls 42 in annularly distributed throughholes in the wall thereof. In the position shown in FIG. 2 the balls 42 are located in an annular groove 44 in the inner wall of the sleeve 28 while simultaneously abutting the peripheral surface of the striking pin shoulder 40. The left hand side end portion of the striking pin 34 passing through the shoulder portion 38 of the ball holder 36 furthermore has a diameter such that when the striking pin is in such a position, with respect to the holder 36, that the shoulder 40 is located entirely to the right of the throughholes of the holder, the balls can move down onto the said end portion of the striking pin, into a position between the shoulder 38 and 40, while simultaneously coming completely out of engagement with the annular groove 44.

A coil spring 46, coaxially arranged about the striking pin 34, extends between the shoulder portion 40 and an end wall 48 at the closed end portion 50 of the cylinder 28. In FIG. 2 the striking pin 34 is kept in a locked position by the spring 46, due to the ball locking device consisting of the ball holder 36, the balls 42 and the groove 44.

A coil spring 52 coaxially arranged about the operating pin 32 of the piston 30 is located between the piston head 30 and the ball holder 36. The spring 52 keeps the piston 30 in the left hand end position, shown in FIG. 2, against an inner shoulder of an end sleeve 54 threaded onto the cylinder 24. The movable parts of the initiator device described may be said to have their respective rest positions in FIG. 2, since the two springs 46 and 52, respectively, are in their least compressed conditions.

In the end sleeve 54 an air filter 56 is attached and the sleeve 54 furthermore carries a coupling 58 for the pressurized air line 20. A plug 60 is connected to the coupling 58 when the initiator is not in use. In the same way a protecting cover 62 may be located on the other end of the initiator when the initiator is not in use. The plug 60 and the protecting cover 62 are, by means of chain lengths 64 and 66, respectively, connected to an eye 66, that is attached on a ring 68 arranged about the cylinder 24. The end portion 50 contains a vent hole 70 communicating with the channel of the sleeve 28. An annular seal 72 may be arranged between the end portion 50 and the protecting cover 62.

The right hand end portion 74 of the striking pin has a reduced diameter and is guided in a coaxial throughhole 76 in the sleeve portion 50, said hole being ended by a chamber 78 for receiving a blasting cap.

To sum up, from the above it should be clear that the striking pin 34 is kept in a position remote from the blasting cap by means of the spring 46, the striking pin at the same time in said position locking the ball holder 36 by means of the balls 42. At the same time the ball holder 36 then functions as a stop for the spring 52 keeping the piston 30 in a position remote from the striking pin.

The initiating device described above operates in the following way. When loading, the explosive charges are connected to a shockwave conductor 10, for example in the form of a plastic tube, which at its free end is provided with a blasting cap put into the chamber 78 (the protecting cover 62 has of course been removed). The initiator is connected via the coupling 58 to an operating air line, e.g. the air line 20 in FIG. 1.

For blasting, the operating air line is pressurized. When the pressure rises, the piston 30, 32 will be shifted to the right in FIG. 2, the spring 52 at the same time being compressed. Upon a predetermined compression of the spring 52, the free end of the operating pin 32 of the piston comes into contact with the left hand end portion of the striking pin 34. The striking pin is then moved to the right with respect to the ball holder 36 while compressing the spring 46. The spring 46 has a spring constant that is considerably smaller than that of spring 52.

Upon a short displacement of the striking pin the balls 42 are released from the groove 44 so that the ball holder 36 is released from the sleeve 28. By the stored energy force of the compressed spring 52, the striking pin will now be thrown against the blasting cap and detonate the same.

Percussion initiating devices of different kinds are known since long ago, most of them being based upon the principle that a pre-compressed spring acts against the striking pin. Malfunction of a blocking device may consequently initiate unintentional detonation.

The present invention avoids this serious problem because the main actuating spring 52 is not compressed and does not store any energy until all operating personnel have removed themselves from the hazardous area, and operation is initiated by applying compressed fluid through the line 20 by operation of the control valve 22 shown in FIG. 1. To allow reuse, the prior art initiators must be demounted and the spring recompressed. By contrast, in the present invention, when the air supply line is vented, the initiator automatically returns to its original condition in response to the force of spring 46 and is ready to be used anew. These properties are essential advantages, from the points of safety, convenience, and efficiency.

The cylinder body 24, the sleeve 28, sleeve 54 and the associated outer parts may be collectively referred to herein as a "housing".

We claim:

1. A device for initiating the explosion of an explosive blasting charge by means of a shock wave transmitted to the charge by means of a shock wave conductor, said device comprising a pressurized fluid operated initiator for detonating a blasting cap to produce the shock wave, said device further comprising a pressurized fluid operated operating element movable from a rest position to an operating position in response to pressurized fluid, a connection means for connecting said operating element through a pressurized fluid line to a remote source of pressurized fluid for operator initiator of the operation of said device, said operating element being operable in said operating position for initiating movement of a striking element against the blasting cap for detonating the same, and means for connecting said device to a shock wave conductor for conducting the shock wave from the blasting cap to a remotely positioned explosive blasting charge for detonation thereof.

2. A device according to claim 1 including blocking means for keeping said striking element in a rest position remote from the blasting cap, spring means for acting upon said striking element in the operating direction thereof, said spring means having energy stored therein by said movement of said operating element to said operating position thereof, said blocking means including means for releasing said striking element in response to movement of said operating element to said operating position to allow the striking element to be driven against the blastng cap by the force of the energy stored in said spring means, and a return spring connected to return said striking element to said rest position.

3. A device according to claim 2 including a guide means extending in alignment with the operating direction of said striking element and confining relative movement of said striking element, said blocking means including a holder and a plurality of balls associated with said holder, said spring means being connected between said operating element and said holder, said striking element and said holder being mechanically connected with said balls, said operating element being operable when in its operating position to force said striking element from the rest position thereof to a predetermined position, said striking element being operable in said predetermined position to release said balls and to thereby release said holder.

4. A device for initiating the explosion of an explosive blasting charge by means of a shock wave transmitted to the charge by means of a shock wave conductor, said shock wave being produced at the end of the shock wave conductor remote from the blasting charge by detonating a blasting cap, said device comprising a pressurized fluid operated initiator associated with the blasting cap for detonating the same and including a pressurized fluid operated operating element movable from a rest position to an operating position in response to pressurized fluid, said operating element being operable in said operating position for initiating movement of a striking element against the blasting cap for detonating the same, blocking means for keeping said striking element in a rest position remote from the blasting cap, spring means for acting upon said striking element in the operating direction thereof, said spring means having energy stored therein by said movement of said operating element to said operating position thereof, said blocking means including means for releasing said striking element in response to movement of said operating element to said operating position to allow the striking element to be driven against the blasting cap by the force of the energy stored in said spring means, a guide means extending in alignment with the operating direction of said striking element and confining relative movement of said striking element, said blocking means including a holder and a plurality of balls associated with said holder, said spring means being connected between said operating element and said holder, said striking element and said holder being mechanically connected with said balls, said operating element being operable when in its operating position to force said striking element from the rest position thereof to a predetermined position, said striking element being operable in said predetermined position to release said balls and to thereby release said holder, said guide means comprising a straight tubular channel, one end of said channel having means for connection to a pressurized fluid line, and the other end of said channel defining a chamber for receiving a blasting cap, said operating element comprising a piston sealingly guided in said channel and said striking element comprising a striking pin, said piston and said striking pin being movably aligned in said channel, said holder comprising a sleeve surrounding said striking pin and having an inner shoulder turned toward the blasting cap end of the channel, a corresponding outer shoulder of the striking pin being turned towards said inner shoulder, said balls in said rest position of said striking pin being located in a transverse groove in the inner surface of said channel and abutting the peripheral surface of said shoulder of said striking pin, said balls being movable radially inwardly for release from said transverse groove to positions between said two shoulders and against the inner surface of said channel to release said holder, said spring means comprising a coil spring extending between said piston and said holder, the end of said piston turned towards said striking pin being spaced at a distance from said striking pin so that said distance plus the distance between said rest position and said predetermined position of said striking pin approximates the required compression displacement distance of said coil spring.

5. A device according to claim 4 including a return spring connected to return said striking element to said rest position.

6. A pressure fluid operated blasting cap detonating device comprising a housing defining a cylindrical inner channel and a chamber for a blasting cap in one end thereof, a striking pin longitudinally movable in said channel and into said chamber to strike a blasting cap in said chamber, a first compression spring positioned and arranged to bias said striking pin to a rest position spaced away from said blasting cap chamber, said striking pin including a radially outwardly extending shoulder at a predetermined axial position thereof in said rest position, said housing including a radially outwardly extending groove in the inner wall of said channel at said predetermined axial position of said striking pin shoulder, a plurality of balls circumferentially spaced around said shoulder and in said groove and substantially filling the space therebetween so that said shoulder maintains said balls within said groove when said striking pin is in said rest position, a holder comprising a sleeve surrounding the shoulder portion of said striking pin and having radial openings therethrough for accommodating said balls and having a rest position with said balls in said groove, said holder having a shoulder facing said balls and facing the blasting cap chamber end of said housing and positioned on the side of said striking pin shoulder opposite to said blasting cap chamber, an operating element comprising a piston sealingly guided within said channel and having a rest position at the end of said channel opposite to said blasting cap chamber, an energy storage compression spring positioned between said piston and said holder and having an unstressed length substantially equal to the distance between the rest positions of said holder and said piston, said piston having a reduced diameter operating pin extending through said energy storage compression spring in the direction of said striking pin, said striking pin having a reduced diameter portion protruding through said sleeve in the direction of said piston, said housing including a fitting for the admission of pressurized operating fluid at the end of said housing accommodating said piston to cause said piston to move against said energy storage compression spring to store energy therein and to ultimately push against the end of said striking pin protruding through said holder sleeve to move said striking pin to a predetermined displaced position, said shoulder of said striking pin being displaced axially in said predetermined displaced position of said striking pin so that the maximum radius of said shoulder is axially displaced away from said peripheral grooves in said channel walls to permit said balls to move radially inwardly and out of said grooves, said balls then being effective to engage between the end portion of said striking pin shoulder and said shoulder of said holder and said cylindrical inner wall of said chamber to cause the mechanical energy stored in said compression spring to be transmitted through said holder and through said balls to said striking pin to thereby cause said striking pin to rapidly travel axially from said predetermined displaced position to strike a blasting cap contained in said blasting cap chamber for detonation thereof.

* * * * *

UNITED STATES PATENT AND TRADEMARK OFFICE

CERTIFICATE OF CORRECTION

PATENT NO. : 4,037,537

DATED : July 26, 1977

INVENTOR(S) : Torgny Thorsell et al

It is certified that error appears in the above-identified patent and that said Letters Patent are hereby corrected as shown below:

Title should read --Device for Blasting--
Insert --[30] Foreign Application Priority Data October 4, 1974 Sweden 12541/74
Column 1, line 63, cancel "i.a." before "usable"
Column 3, line 10, "present" should read --prevent--
line 56, before "channel" insert --inner--
Column 4, line 63, "initiator" should read --controlled initiation--

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*